US006839528B2

(12) United States Patent
Yamaguchi

(10) Patent No.: US 6,839,528 B2
(45) **Date of Patent: *Jan. 4, 2005**

(54) CLEANING DEVICE WITH MULTIPLE CLEANING MEMBERS FOR A DEVELOPER IMAGE CARRIER

(75) Inventor: Yuka Yamaguchi, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/679,301

(22) Filed: Oct. 7, 2003

(65) Prior Publication Data

US 2004/0071484 A1 Apr. 15, 2004

Related U.S. Application Data

(63) Continuation of application No. 10/028,445, filed on Dec. 28, 2001, now Pat. No. 6,661,983.

(51) Int. Cl.[7] ..... G03G 15/16; G03G 21/00

(52) U.S. Cl. ..... 399/101; 399/297; 399/349; 399/352; 399/353

(58) Field of Search ..... 399/101, 297, 399/343–345, 348, 349, 353; 15/256.5, 256.51, 256.52

(56) References Cited

U.S. PATENT DOCUMENTS

| | | | | |
|---|---|---|---|---|
| 5,534,983 A | 7/1996 | Kubo | ..... | 399/297 |
| 5,911,101 A | 6/1999 | Park | ..... | 399/345 |
| 5,970,281 A | 10/1999 | Park | ..... | 399/101 |
| 6,490,424 B2 | 12/2002 | Okamoto | ..... | 399/101 |
| 6,661,983 B2 * | 12/2003 | Yamaguchi | ..... | 399/101 |

FOREIGN PATENT DOCUMENTS

JP 10-149033 A 6/1998

* cited by examiner

*Primary Examiner*—William J. Royer
(74) *Attorney, Agent, or Firm*—Foley & Lardner LLP

(57) ABSTRACT

A cleaning device of this invention has a first cleaning member that is provided opposing to a developer image carrier for the scraping of the surface of the developer image carrier and a second cleaning member that is put over the first cleaning member and runs between the surface of the developer image carrier and the first cleaning member for the wiping of the surface of the developer image carrier simultaneously with the scraping of the surface of the developer image carrier by the first cleaning member. This cleaning device is used for cleaning of the developer image carrier of an image forming apparatus.

3 Claims, 3 Drawing Sheets

CLEANING DEVICE WITH MULTIPLE CLEANING MEMBERS FOR A DEVELOPER IMAGE CARRIER

The present application is a continuation of U.S. application Ser. No. 10/028,445, filed Dec. 28, 2001 now U.S. Pat. No. 6,661,983, the entire contents of which are incorporated herein by reference.

BACKGROUND OF THE INVENTION

1. Field of the Invention

The present invention relates to a cleaning device for cleaning residual toner remaining on a developer image carrier and an image forming apparatus equipped with this cleaning device.

2. Description of the Related Art

As an image forming apparatus to form a toner image on a photosensitive body according to an electrophotographic system, in recent years it has been planned to put a wet type image forming apparatus using toner particles as extremely fine as sub-micron in practical use. Especially, in the case of a full-color image forming apparatus capable of obtaining a full-color toner image by superposing plural color toners has such merits as it is economical because a sufficient image density is obtained from small amounts of toners, texture comparable to printing (for example, offset printing) can be realized and further, energy saving is attained as a developer image can be fixed at relatively low temperatures, and the more practical use of a wet type image forming apparatus is expected.

However, in the case of this wet type image forming apparatus, toner particles are extremely fine and it is difficult to remove residual toners remaining on a photosensitive body or an intermediate transfer body after completing the transfer and toners tend to remain on the photosensitive body or the intermediate transfer body as toners are not completely removed. As a result, there were problems such that toners left on the photosensitive body or the intermediate transfer body were offset on a developing roller or a sheet of paper acting as a transfer paper. Also, the toners mixed in a developing device and produced developers of mixed colors or contaminated a toner image formed on a sheet paper. Further, toners adhered on the photosensitive body or the intermediate transfer body were hardened to a film shape, and produced a filming phenomenon and image void. Therefore, maintenance to remove toners adhering on the photosensitive body or the intermediate transfer body was necessitated frequently.

On the other hand, in the case of an image forming apparatus for forming a developer image on a photosensitive body according to the electrophotographic system, a technology is disclosed in Japanese Patent Publication No. 10-149033 for cleaning a photosensitive body after completing the transfer of image by an image forming apparatus equipped with a cleaning device comprising a rotary brush and a web system wiping device.

However, according to this conventional technology it was necessary to arrange cleaning devices having different functions separately around a photosensitive body after completing the transfer and a broad space was required and the realization of a small sized image forming apparatus was impeded.

Accordingly, improvement of cleaning characteristic without impeding saving of the space requirement for a cleaning device is desired for surely removing residual toner on a photosensitive body and an intermediate transfer body.

SUMMARY OF THE INVENTION

The objects of this invention are to promote cleaning characteristics of a cleaning device without impairing space saving, obtain a high quality image by preventing mixture of color developers by residual toners, contamination of images, drop of image quality in order for surely removing residual toners remaining on a photosensitive body and intermediate transfer body and reducing maintenance requirement.

According to the embodiments of this invention, there is provided a cleaning device comprising: a first cleaning member that is provided opposing to a developer image carrier for scraping the surface of the developer image carrier; and a second cleaning member that is put over the first cleaning member and runs between the surface of the developer image carrier and the first cleaning member for wiping the surface of the developer image carrier simultaneously with the scraping of the surface of the developer image carrier.

Further, according to this invention, there is provided an image forming apparatus comprising: a latent image carrier; an image forming unit to form a developer image on the latent image carrier; a transferring device to transfer the developer image formed on the latent image carrier on a transfer body; and a cleaning device that has a first cleaning member having a function to scrape the surface of the latent image carrier, a second cleaning member having a function to run between the surface of the latent image carrier and the first cleaning member for wiping the surface of the latent image carrier, and simultaneously executes the scraping by the first cleaning member and the wiping by the second cleaning member.

Further, according to another embodiment of this invention, there is provided an image forming apparatus comprising: a latent image carrier; an image forming unit to form a developer image on the latent image carrier; an intermediate transfer body to secondarily transfer the developer image that is primarily transferred from the latent image carrier to a transfer material; and a cleaning device that is provided opposing to the intermediate transfer body, has a first cleaning member having a scraping function of the surface of the intermediate transfer body and a second cleaning member having a wiping function of the surface of the intermediate transfer body by running between the intermediate transfer body surface and the first cleaning member in the state of being put over the first cleaning member and the wiping by the second cleaning member.

DETAILED DESCRIPTION OF THE INVENTION

Figure 1:
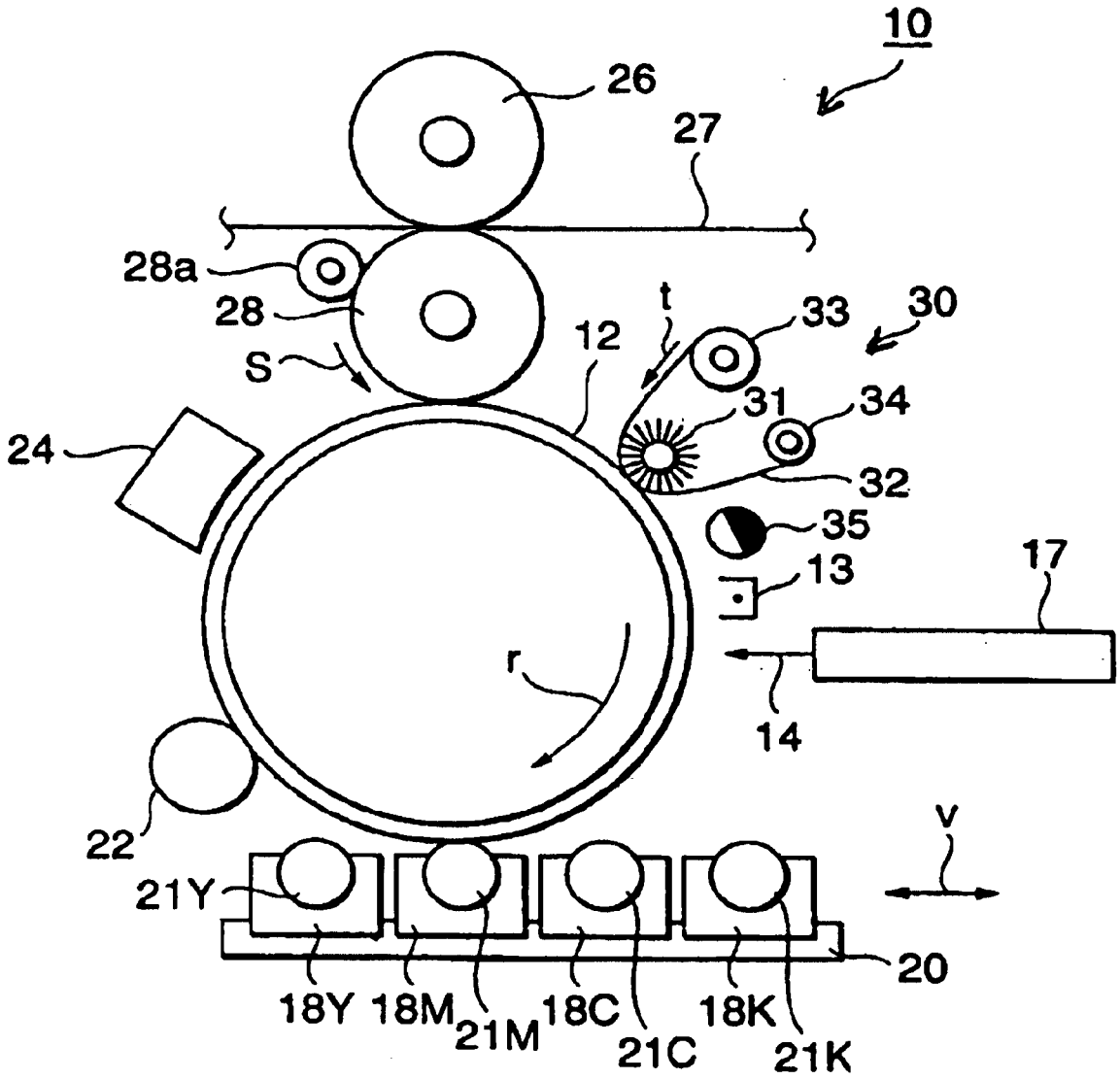
FIG. 1 is a schematic diagram showing an image forming portion in a first embodiment of the present invention.
Figure 2:
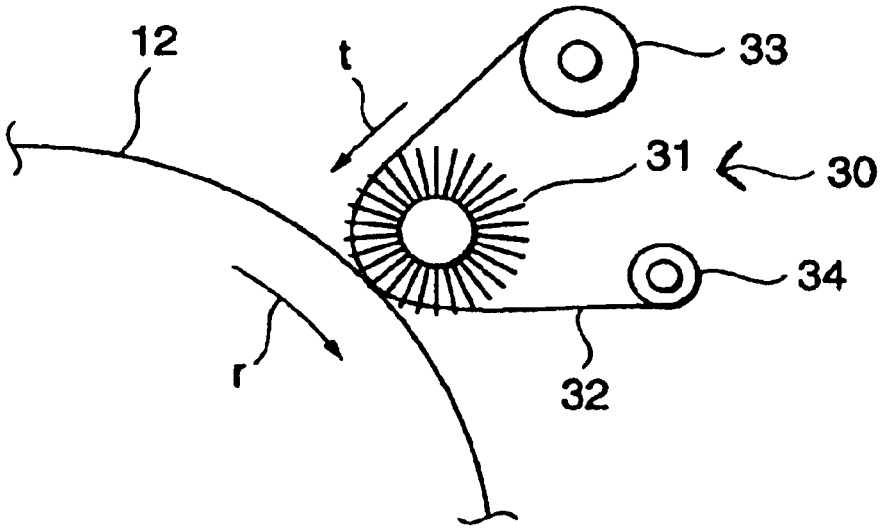
FIG. 2 is a schematic diagram showing a cleaning device in a first embodiment of the present invention.

Embodiments of the present invention will be described in detail referring to the attached drawings. FIG. 1 shows an image forming portion 10 of a color electrophotographic apparatus in a first embodiment of the present invention. A photosensitive drum 12, which is a developer image carrier, has a photosensitive layer of amorphous silicone provided on a conductive solid base of aluminum and on which a protective layer composed of amorphous silicone carbide (a-SIC), amorphous carbon (a-C), fluorine containing a-C is preferably formed. Around the photosensitive drum 12 that is rotating in the arrow direction r at a peripheral velocity 100 mm/sec., a charging device 13 comprising well-known Scorotron chargers, an exposing device 17 for forming electrostatic latent images by attenuating potentials at exposed portions by applying exposing light 14 which is demodulated according to yellow (Y), magneta (M), cyan (C) and black (BK) image data to the photosensitive drum 12 are arranged along the rotating direction of the drum 12.

Further, around the photosensitive drum 12, there are arranged four developing devices 18Y–18K which are installed on a developing unit base 20 and holding different liquid developers of yellow (Y), magenta (M), cyan (C) and (BK) colors. These developing devices 18Y–18K have developing rollers 21Y–21K which supply respective liquid developers to the surface of the photosensitive drum 12.

The liquid developers are toner particles in particle size 0.1–3 $\mu$m dispersed in carrier liquid and comprise mainly coloring agent, resin, additive and carrier liquid. Carbon and various color pigments for coloring agents, acrylic resin and styrene resin which are proper as toner material for resin, and charge control agent represented by metallic soap, dispersing agent for additives are used. Further, highly resistant and low viscous insulating liquid and, for example, such iso-paraffin hydrocarvon as Iso-Paraffin L (the trade mark of Exxon), normal paraffin hydrocarbon such as Norpar (the trade mark of Exxon) are used.

At downstream side of the developing devices 18Y–18K around the photosensitive drum 12, there are a squeeze device 22 for making excess liquid developer remaining on the photosensitive drum 12 to a thin layer in order to prevent a white fog of a developer image and a drying device 24 for drying up excess carrier liquid by blowing high speed air upon the photosensitive drum 12. The squeeze device 22 comprises an air sucking device or squeeze rollers that have a liquid sucking property and compresses a toner image adhered to an electrostatic latent image on the surface of the photosensitive drum 12 against the photosensitive drum 12 more strongly by electophoresis when a bias voltage is applied.

At the downstream side of the drying device 24 around the photosensitive drum 12, there is an intermediate transfer roller 28 that is a developer image carrier for secondarily transferring a toner image primarily transfer from the photosensitive drum 12 on a sheet of paper that is a transfer paper conveyed by back-up rollers 26. The intermediate transfer roller 28 rotates in the arrow direction S and has a cleaning roller 28*a* at the downstream side of the secondary transferring position to a sheet of paper 27.

Further, at the downstream side of the intermediate transfer roller 28 around the photosensitive drum 12, there are a cleaning device 30 that removes residual toner remaining on the photosensitive drum 12 after competing the toner image transfer to the intermediate transfer roller 28 and a blanking lamp 35 that eliminates residual charge remaining on the surface of the photosensitive drum 12 and are kept separated during the toner image forming process to obtain a full-color image by superposing yellow (Y), magenta (M), cyan (C) and black (BK) toner images on the photosensitive drum 12.

The cleaning device 30 comprises a brush roller 31 that is a first cleaning member having a function to scrape the surface of the photosensitive drum 12 and a web sheet 32 that is a second cleaning member having a function to wipe off the surface of the photosensitive drum 12 that is wound around the brush roller 31, and the cleaning device 30 is brought in contact with the photosensitive drum 12 in the state with the web sheet 32 put over the surface of the brush roller 31. The web sheet 32 travels in the arrow direction t of the winding roll 34 and rolled up at a moving velocity 0.3 mm/sec. from the sending out roll 33. At this time, the brush roller 31 also rotates at the same velocity as the web sheet 32.

The brush roller 31 comprises nylon brushed 3–4 mm long, 0.3 mm thick at a density about 210–30 pieces/mm$^2$ and have moderate minuteness and stiffness to show an effect to scrape toners on the surface of the photosensitive drum 12. The web sheet 32 is made of processed woven fabric or non-woven fabric of various fibers such as polyester, acrylic, polyimide, metal and cellulose in the thickness of 500 $\mu$m thinner than the planted length of the brush roller 31 and density 0.3–0.4 g/cm$^3$.

Thus, the brush hairs of the brush roller 31 partially come out through the texture of the web sheet 32 that is put over the surface of the brush roller 31 and directly contact the photosensitive drum 12 at the contacting position to the photosensitive drum 12.

Next, the operations will be described. When the image forming process is started and the photosensitive drum 12 is rotated in the arrow direction r, the photosensitive drum 12 is uniformly charged by the charging device 13 and after laser beams modulated by the exposing device 17 based on the yellow image data that is a first color image data is selectively applied, and electrostatic latent image corresponding to a yellow image is formed and arrives at the developing position.

At developing position, the developing unit base 20 is slid in the arrow direction v and developing roller 21Y of the yellow (Y) developing device 18Y containing an yellow (Y) liquid developer is arranged oppositely. A liquid developer is supplied to the elecrostatic latent image on the photosensitive drum 12 by the developing roller 21Y and an yellow (Y) toner image is formed on the photosensitive drum 12. Then, excess liquid developer on the photosensitive drum 12 is scraped by the squeezing device 22 and the liquid developer is made to a thin layer and an yellow (Y) toner image adhered to the electrostatic latent image is strongly pressed against the photosensitive drum 12.

Thereafter, the yellow (Y) toner image on the photosensitive drum 12 is passed through the drying device 24 and the carrier liquid slightly remaining on the surface of the photosensitive drum 12 is dried and removed by the high speed blowing air. Thus, only a developer image formed by yellow (Y) toner particles is left on the surface of the photosensitive drum 12.

Further, the yellow (Y) toner image passes the opposing position to the intermediate transfer roller 28. At this time, the intermediate transfer roller 28 is separated from the photosensitive drum 12 and the toner image on the photosensitive drum 12 advances to the cleaning device 30 without being transferred on the intermediate transfer roller 28. Because the cleaning device 30 is also separated from the surface of the photosensitive drum 12, the yellow (Y) toner image is not cleaned and electrostatic latent image corresponding to Yellow (Y) is erased by the blanking lamp 35.

As described above, after forming a toner image by Yellow (Y) toner particles while the photosensitive drum 12 is rotated by one turn, a second color toner image forming process is executed likewise the Yellow (Y) toner image. That is, while retaining the Yellow (Y) toner image, the photosensitive drum 12 is uniformly charged again by the charging device 13 likewise the formation of the first Yellow (Y) toner image, the exposing light 14 that is modulated based on a magenta (M) image data, that is a second color image data, is applied selectively by the exposing device 17 and arrives at the developing position of an electrostatic latent image corresponding to a magenta image.

During this period, the developing unit base 20 is slid in the arrow direction v. A magenta (M) developing device 18M is arranged at the developing position instead of the yellow (Y) developing device 18Y and an electrostatic latent image formed on the surface of the photosensitive drum 12 is developed by a magenta (M) liquid developer. Then, the yellow (Y) and the magenta (M) toner images are put over each other on the surface of the photosensitive drum 12.

Then, likewise the yellow (Y) toner image forming, after drying excess carrier liquid by the drying device 24, the magenta (M) electrostatic latent image passes through the intermediate transfer roller 28 and the cleaning device 30 and the magenta (M) electrostatic latent image is erased by the blanking lamp 35 and the operation is shifted to forming the next color toner image. By repeating the same operation four times, the photosensitive drum 12 is rotated by 4 times, toner images of yellow (Y), magenta (M), cyan (C) and black (K) toner articles are superposed and a full color toner image is obtained.

After completing the toner image forming process, in order to execute the transferring process, press contact of the intermediate transfer roller 28 to the photosensitive drum 12 and bringing the cleaning device 30 to contact with the photosensitive drum 30. A full-color toner image formed on the surface of the photosensitive drum 12 under this state reaches the intermediate transfer roller 28 and is first transferred to the intermediate transfer roller 28 by a difference in the surface energy, heat and pressure between the photosensitive drum 12 and the intermediate transfer roller 28.

The full-color toner image primarily transferred to the intermediate transfer roller 28 is secondarily transferred on a sheet of paper 27 that is clamped and conveyed between the intermediate transfer roller 28 and the back-up roller 26 synchronous with the full-color developer image on the intermediate transfer roller 28, and a full-color image is thus obtained on the sheet of paper 27. The secondary transfer mechanism of a full-color toner image from the intermediate transfer roller 28 to the sheet of paper 27 is due to difference in heat, pressure and the surface energy between the intermediate transfer roller 28 and the sheet of paper 27. Further, the intermediate transfer roller 28 is cleaned by the cleaning roller 28*a* after the secondary transfer of the full-color toner image onto the sheet of paper 27 and becomes ready for the next primary transfer.

On the other hand, after transferring a full-color toner image to the intermediate transfer roller 28, the photosensitive drum 12 reaches the cleaning device 30. At the cleaning device 30, the brush roller 31 and the web sheet 32 run in the arrow direction t at a moving velocity 0.3 mm/sec. which is lower than the peripheral velocity 100 mm/sec. of the photosensitive drum 12, and the toner scraping function of the brush roller 31 and the wiping function of the web sheet 32 act on residual toner on the photosensitive drum 12 simultaneously and the residual toner is removed. The web sheet 32 is wound around the winding roll 34 from the sending out roll 33 and a new surface is always kept in contact with the photosensitive drum 12, preventing the wiped residual toner from returning to the photosensitive drum 12. Then, the residual electric charge on the photosensitive drum 12 is removed by the blanking lamp 35 and a series of image forming processes is terminated.

When the cleaning state of the residual toner on the surface of the photosensitive drum 12 by the cleaning device 30 was observed, toner adhered by incomplete cleaning was not recognized and a good cleaning characteristic was obtained.

According to the first embodiment, in order to achieve space saving, the brush roller 31 and the web sheet 32 are arranged by putting them over each other and the scraping function and the wiping function of the photosensitive drum 12 are made to act simultaneously. As a result, a high cleaning characteristic is obtained by the cleaning device 30 even when toner particles are fine and residual toner on the photosensitive drum 12 can be surely removed. Accordingly, the high cleaning characteristic can be realized in a saved space and a small sized image forming apparatus can be achieved. Further, it is possible to prevent generation of mixed color caused by mixing of residual toner on the photosensitive drum 12 into the developer, generation of contamination of a toner image by toner, and defective image quality resulting from the toner filming on the photosensitive drum 12, and obtain a high quality of developer image and reduce the maintenance requirement.

Next, a second embodiment of this invention will be described. In this second embodiment, a cleaning assistant agent is used for the cleaning device in the first embodiment. Accordingly, in this second embodiment, the same component elements as those described in the first embodiment are assigned with the same reference numerals and the detailed explanation thereof will be omitted.

Figure 3:
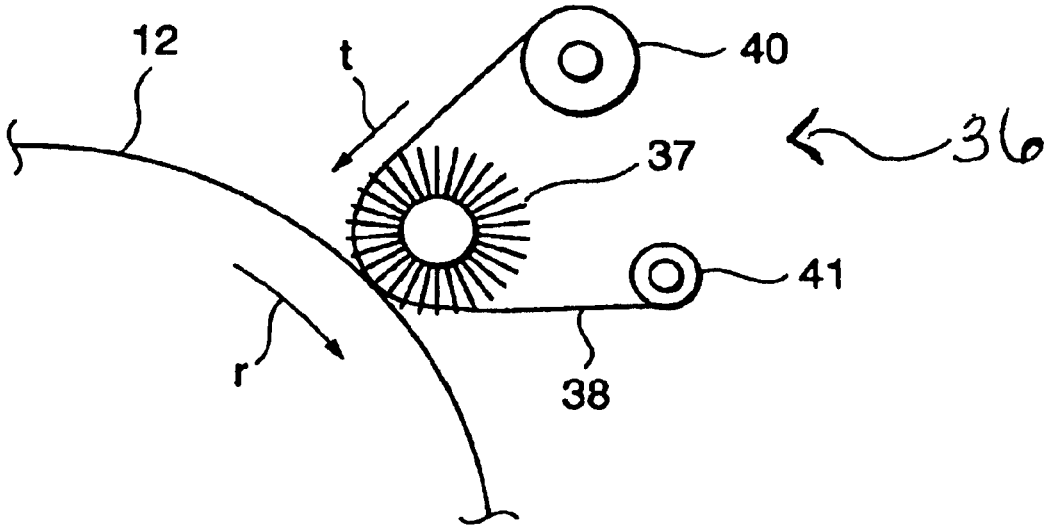
FIG. 3 is a schematic diagram showing a cleaning device in a second embodiment of the present invention.

A cleaning device 36 that can be brought in contact with or separated from the photosensitive drum 12 as shown in FIG. 3 is in contact with the photosensitive drum 12 in the state wherein a web sheet 38 is put over the surface of a brush roller 37 likewise the first embodiment described above. The web sheet 38 is woven or non-woven in 300 $\mu$m thick, impregnated in Isopar L (the trade mark of Exxon) that is the same as carrier liquid as a cleaning assistance agent and runs from a sending roll 40 and wound around a winding roll 41.

Using the cleaning device 36, a full-color toner image is formed on the sheet of paper 27 by the image forming process similar to the first embodiment. After transferring a full-color toner image on the intermediate transfer roller 28, residual toner remaining on the photosensitive drum 12 is removed by cleaning device 36 and the residual toner cleaning state on the surface of the photosensitive drum 12 was observed. A more satisfactory cleaning characteristic was obtained by the cleaning assistant agent in addition to the scraping function of the brush roller 37 and the wiping function of the web sheet 38.

According to this second embodiment, likewise the first embodiment described above, since the scraping function and the wiping function act on the photosensitive drum 12 simultaneously and furthermore, the cleaning effect by the cleaning assistant agent, the cleaning device 36 is able to obtain a high cleaning characteristic and surely remove residual toner on the photosensitive drum 12. Accordingly, it is possible to achieve a small size image forming apparatus by a reduced space and a developer image of high quality, and furthermore, the maintenance requirement can be reduced.

Further, this invention is not limited to the embodiments described above but variously can be modified within its spirit and scope. For example, the structure and processes of an image forming apparatus are not restricted and an image forming apparatus may not be for forming color images. In a color image forming apparatus, color toner images may not be superposed on a photosensitive drum but may be superposed on an intermediate transfer device. Further, the image forming apparatus may be so constructed that plural image forming units are arranged around a photosensitive drum and a color developer image is obtained by superposing plural color toner images while rotating the photosensitive drum by one turn without forming a toner image for one color when rotating the photosensitive drum by one turn. Further, developers are not limited to liquid developers but dry type developers may be used optionally.

Figure 4:
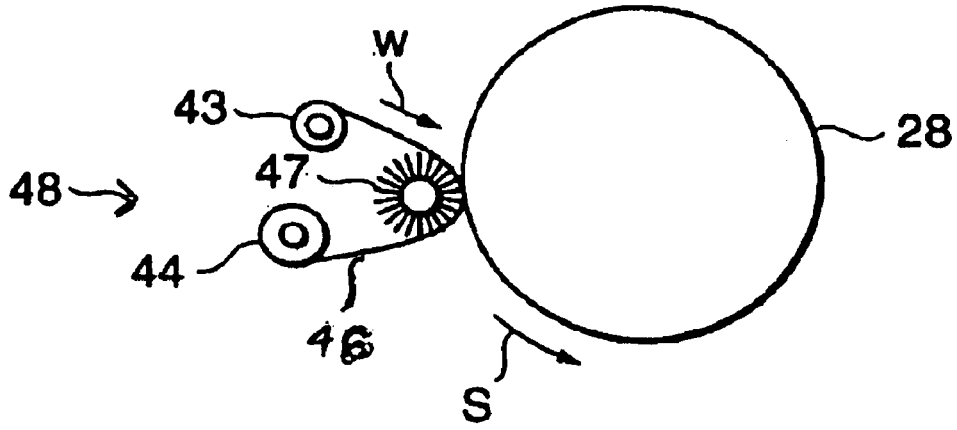
FIG. 4 is a schematic diagram showing a cleaning device in a first deformed example of the present invention.

Further, a cleaning device is not restricted to clean a photosensitive drum but may be used for cleaning the intermediate transfer roller 28 as in the first embodiment. That is, as in a first modified example shown in FIG. 4, the intermediate transfer roller 28 may be cleaned using a cleaning device 48 comprising a web sheet 46 that is wound around on the surface of a brush roller 47 and runs in the arrow direction w to a winding roll 44 from a sending roll 43. Thus, residual toner on the intermediate transfer roller 28 can be surely removed.

Figure 5:
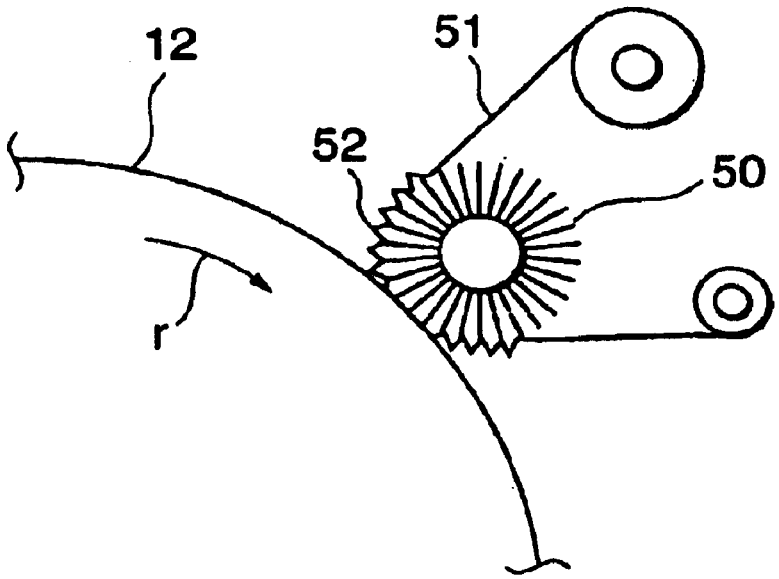
FIG. 5 is a schematic diagram showing a cleaning device in a second deformed example of the present invention.

Further, for example, in the first embodiment, the brush roller 31 may not get through the textile of the web sheet 32 but may form only a rough portion 52 on the surface of the web sheet 51 that is put over the surface of the brush roller 50, for example, as in a second deformed example shown in FIG. 5. Even in this case, the scraping function by an elastic force of the brush roller 50 is not impaired and acts via the web sheet 51.

In addition, the process speed of the image forming apparatus are also not limited but, for example, in the first embodiment the peripheral velocity of the photosensitive drum is desirable at about 50–300 mm/sec. In this case, it is desirable to set the moving velocity of the web sheet of the cleaning device in a range of 0.05–5 mm/sec.

Further, the structure, drive, of the cleaning device are also not limited and the driving of the first cleaning member is not restricted provided that the scraping function can be maintained and, for example, the brush roller in the first embodiment can be stationary or can be rotated in the direction reverse to the rotary direction of the photosensitive drum. Further, the first cleaning member is not limited to a brush if the scraping function is obtained and may be a drum having elastic projections for scraping formed thereon. The length of brush can be 2–5 mm and the thickness can be 100–500 $\mu$m. Further, if the wiping function is maintained and the function of the first cleaning member is not prevented, the second cleaning member can be in thickness 20–1000 $\mu$m or preferably 50–500 $\mu$m and density 0.2–0.8 g/cm$^3$.

According to this invention as described above in detail, in order for saving space, a first cleaning member having a scraping function and a second cleaning member having a wiping function are put over each other and the scraping and wiping functions are forced to act simultaneously on residual toner on a developer image carrier. So, irrespective of the particle size of toner, a high cleaning characteristic is obtained and residual toner can be surely removed. As a result, a high cleaning characteristic can be realized with a saved space and a small size image forming apparatus is obtained. Further, color mixing of the developer resulting from improper cleaning of residual toner, contamination of developer images by toner offset and defective image quality caused from adherence of toner to the photosensitive drum can be prevented, a high quality developer image is obtained and the maintenance requirement can be reduced.

What is claimed is:

1. A cleaning device comprising:

a first cleaning member that is opposed to a developer image carrier and scrapes the surface of the developer image carrier; and a second cleaning member that wipes the surface of the developer image carrier simultaneously with the scraping of the surface of the developer image carrier by the first cleaning member.

2. A cleaning device according to claim 1, wherein the first cleaning member is a roller having elastic projections and the second cleaning member is a sheet formed of fiber.

3. A cleaning device according to claim 2, wherein the roller is a brush roller and the sheet is a woven fabric or a non-woven fabric.

* * * * *